US009975130B2

(12) United States Patent
Dejong et al.

(10) Patent No.: US 9,975,130 B2
(45) Date of Patent: May 22, 2018

(54) TRIGGER SPRAYERS AND METHODS FOR MAKING THE SAME

(75) Inventors: David L. Dejong, Ogden, UT (US); Steven L. Sweeton, Lake Winnebago, MO (US); Joseph K. Dodd, Lee's Summit, MO (US)

(73) Assignee: SILGAN DISPENSING SYSTEMS CORPORATION, Grandview, MO (US)

( * ) Notice: Subject to any disclaimer, the term of this patent is extended or adjusted under 35 U.S.C. 154(b) by 1422 days.

(21) Appl. No.: 13/264,447

(22) PCT Filed: Apr. 22, 2010

(86) PCT No.: PCT/US2010/031970

§ 371 (c)(1),
(2), (4) Date: Oct. 14, 2011

(87) PCT Pub. No.: WO2010/124040

PCT Pub. Date: Oct. 28, 2010

(65) Prior Publication Data

US 2012/0032004 A1 Feb. 9, 2012

Related U.S. Application Data

(60) Provisional application No. 61/172,119, filed on Apr. 23, 2009.

(51) Int. Cl.
*B05B 11/00* (2006.01)

(52) U.S. Cl.
CPC ..... *B05B 11/3047* (2013.01); *B05B 11/3011* (2013.01); *B05B 11/3057* (2013.01); *B05B 11/3064* (2013.01); *B05B 11/3074* (2013.01); *B05B 11/3077* (2013.01)

(58) Field of Classification Search
USPC ..... 239/329, 331, 333, 375, 526, 546; 222/214, 336, 340, 372, 383.1, 384, 406, 222/407
See application file for complete search history.

(56) References Cited

U.S. PATENT DOCUMENTS

| | | | | | |
|---|---|---|---|---|---|
| 4,232,828 | A | * | 11/1980 | Shelly, Jr. | 239/329 |
| 4,767,033 | A | * | 8/1988 | Gemperle | 222/383.2 |
| 5,228,602 | A | * | 7/1993 | Maas et al. | 222/340 |
| 5,716,008 | A | * | 2/1998 | Nottingham et al. | 239/333 |
| 5,984,149 | A | * | 11/1999 | Thanisch et al. | 222/340 |
| 6,116,472 | A | * | 9/2000 | Wanbaugh et al. | 222/340 |
| 6,641,003 | B1 | * | 11/2003 | Foster et al. | 222/383.1 |

FOREIGN PATENT DOCUMENTS

| | | |
|---|---|---|
| EP | 1013345 A2 | 6/2000 |
| JP | 11047650 A | 2/1999 |

OTHER PUBLICATIONS

International Search Report and Opinion on PCT/US2010/031970, dated Nov. 2, 2010.

* cited by examiner

*Primary Examiner* — Ryan A Reis
(74) *Attorney, Agent, or Firm* — Barlow, Josephs & Holmes, Ltd.

(57) ABSTRACT

A trigger sprayer (100) may include a tube retainer (110) fitted in a valve body (120), a piston (140) fitted in the valve body and an integrated trigger (150) and biasing member (154) connected to the piston and the valve body and biased in part by the attachment of a shroud (130) to the trigger sprayer.

9 Claims, 15 Drawing Sheets

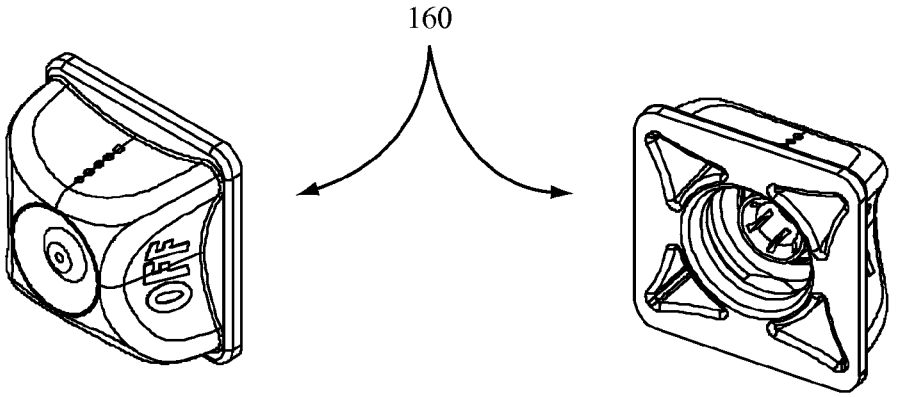
FIG. 15
FIG. 16
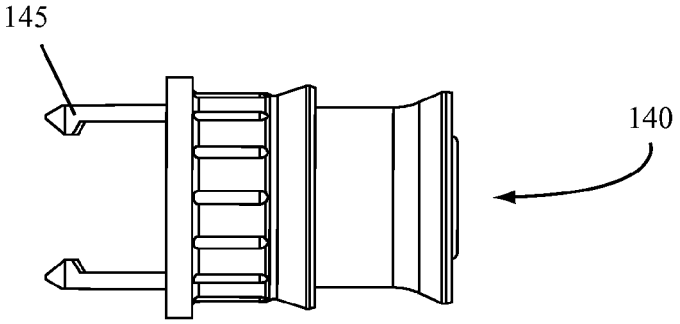
FIG. 17
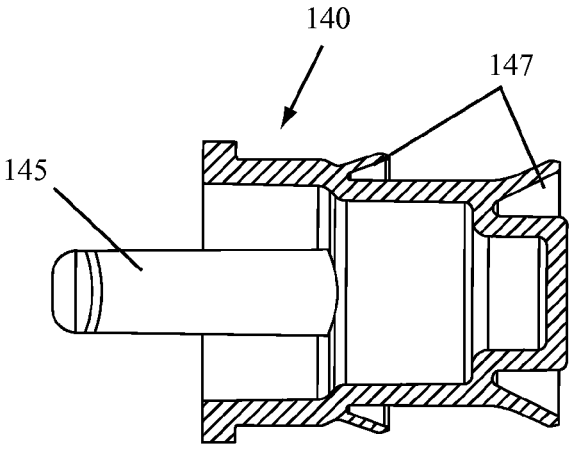
FIG. 18

TRIGGER SPRAYERS AND METHODS FOR MAKING THE SAME

CROSS-REFERENCE TO RELATED APPLICATIONS

This application is a National Phase application of PCT Application PCT/US2010/31970, entitled "TRIGGER SPRAYERS AND METHODS FOR MAKING THE SAME," filed 22 Apr. 2010, which claims the benefit of U.S. Provisional Application No. 61/172,119, entitled "TRIGGER SPRAYERS AND METHODS FOR MAKING THE SAME," filed 23 Apr. 2009, each of which are incorporated herein by reference in their entirety.

BACKGROUND OF THE INVENTION

Field of the Invention

The present invention relates to trigger sprayer devices and more particularly to trigger sprayer devices made entirely, or substantially, from a plastic material.

State of the Art

Trigger sprayers, trigger sprayer devices, and trigger actuated pump sprayers are well known and their use is commonplace in many households and businesses. Typically, a trigger sprayer includes a pump chamber whose volume is varied by movement of a piston within the pump chamber. The piston is typically biased by a spring and is attached to a trigger lever. Actuation of the trigger lever moves the piston within the pump chamber and compresses the spring; this is sometimes referred to as the pump stroke or pressure pump stroke. Release of the trigger lever releases the force on the spring and the spring pushes the piston back to a resting position; which is sometimes called the suction stroke or return stroke. A typical trigger sprayer also includes an inlet valve and an outlet valve. During the pump stroke, product in the pump chamber is pressurized and upon reaching a certain pressure the outlet valve is opened, allowing the product in the pump chamber to escape through the outlet valve. During the return stroke, the outlet valve is shut and the inlet valve is opened. The return of the piston caused by the spring force draws product through the inlet valve into the pump chamber. A typical trigger sprayer will also include a dip-tube for delivering product to the trigger sprayer inlet valve, and an orifice for dispersing the product exiting the outlet valve. The orifice may be attached to or included in a nozzle which is part of the trigger sprayer.

Many different types of trigger sprayers are available in the market and alternative trigger sprayer features abound. However, customers are always looking for cheaper and better features and trigger sprayers. In order to reduce costs, part counts are reduced and assembly processes are simplified. In addition, cheaper materials and fewer materials are used to reduce the costs associated with trigger sprayers.

Most trigger sprayers include metal parts. For instance, the spring used to bias the piston in a pump chamber is typically made of steel. Ball valves using steel balls are also typically used as inlet and outlet valves for trigger sprayers. Metal springs and balls can be costly. In addition, metal in the flow path of a product can present compatibility issues with product flowing through the trigger sprayer. The use of steel balls for valves also adds components to the trigger sprayer, increasing the complexity of assembly and sourcing. The use of metal also hinders the recyclability of a trigger sprayer because many of the available recycling services do not accept mixed-component products for recycling.

Therefore, it may be desirable to develop trigger sprayers made of a single material and to design trigger sprayers which may be more effectively assembled and produced.

BRIEF SUMMARY OF THE INVENTION

According to certain embodiments of the invention, a trigger sprayer may include a valve body, a tube retainer positioned in the valve body, a trigger attached to or configured to fit with the valve body and a shroud. The trigger may include an integral trigger lever and biasing member or spring. When actuated, the trigger lever stresses the biasing member which may move within the shroud. The biasing member may be configured to return the trigger lever to a non-actuated position when force on the trigger lever is released.

According to various embodiments of the invention, the trigger may work with the shroud to impart a bias force on a piston through the trigger in order to return the piston to a beginning position and to fill a pump chamber.

In some embodiments of the invention, an inlet valve and an outlet valve may be molded with a tube retainer or as a singular piece such that the valves allow fluid or product to move from a container into a pump chamber and out of the pump chamber to be dispersed by a trigger sprayer.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

FIG. 15 illustrates a nozzle according to various embodiments of the invention;

FIG. 16 illustrates a nozzle according to various embodiments of the invention;

FIG. 17 illustrates a piston according to various embodiments of the invention;

FIG. 18 illustrates a cross-sectional view of a piston according to various embodiments of the invention;

DETAILED DESCRIPTION OF THE INVENTION

According to various embodiments of the invention, a trigger sprayer may be made from a single plastic material or multiple plastic materials and may include a valve body, a piston, an inlet valve, an outlet valve, and a trigger and spring combination. For instance, all of the components of the trigger sprayer may be made from polypropylene. A trigger sprayer according to various embodiments of the invention may also include any one or more of a shroud, a nozzle, a closure, a gasket, and a dip-tube. Trigger sprayers according to various embodiments of the invention may be fixed, removeably secured, or in communication with a container or product source containing a product to be dispensed by the trigger sprayer.

Figure 1:
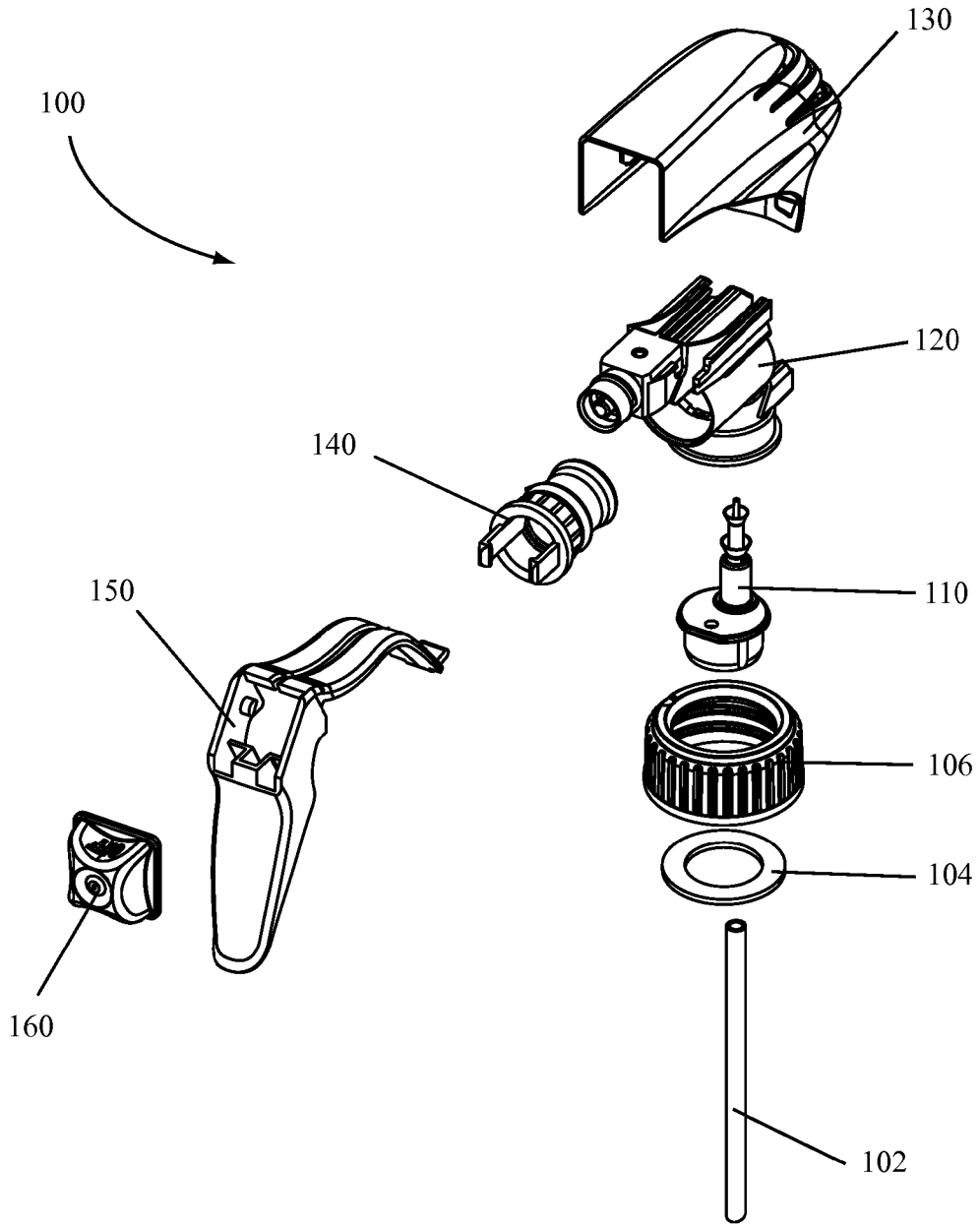
FIG. 1 illustrates various components of a trigger sprayer assembly according to various embodiments of the invention.

Components of a trigger sprayer according to various embodiments of the invention are illustrated in FIG. 1. As illustrated, a trigger sprayer 100 may include a valve body 120, a tube retainer 110, a piston 140, a trigger 150 and a shroud 130. The trigger sprayer 100 may also include a nozzle 160 and components for attaching the trigger sprayer 100 to a container; for example, a trigger sprayer 100 may include a closure 106 and a gasket 104. A dip-tube 102 may connect to the tube retainer 110 as needed.

Figure 2:
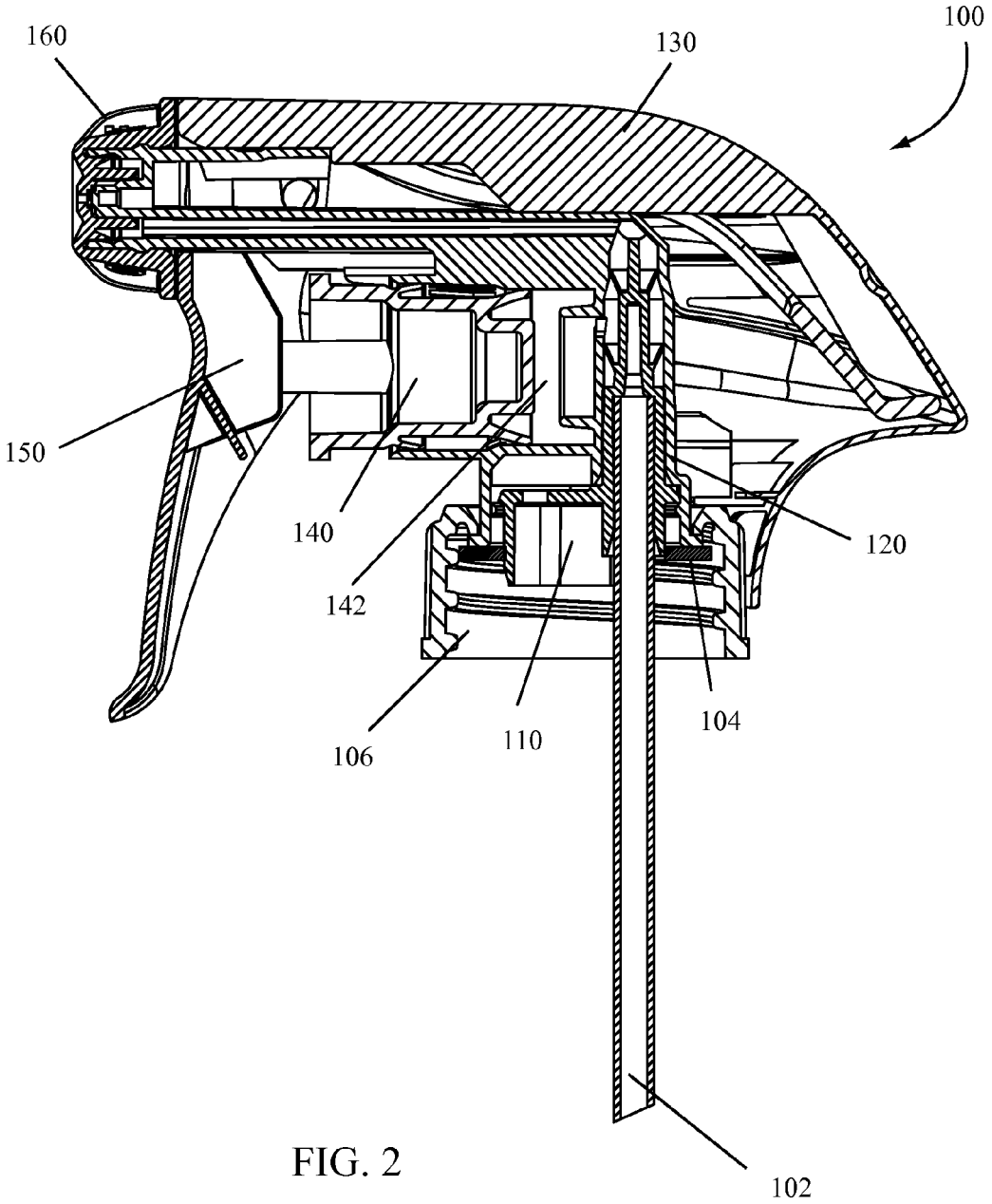
FIG. 2 illustrates a cross-sectional side view of an assembled trigger sprayer according to various embodiments of the invention.

A cross-sectional side view of an assembled trigger sprayer 100 using the components illustrated in FIG. 1 is illustrated in FIG. 2. As illustrated, the tube retainer 110 fits within the valve body 120 and may be inserted in a flow passage of the valve body 120. A portion of the piston 140 also fits within a portion of the valve body 120, forming a pump chamber 142 in the volume between the piston 140 and the valve body 120. The piston 140 may also be connected to the trigger 150. Movement of the trigger 150 may translate into movement of the piston 140 within the valve body 120. The shroud 130 may fit over a portion of the valve body 120 and may be attached to or fixed on the valve body 120 as desired.

Figure 3:
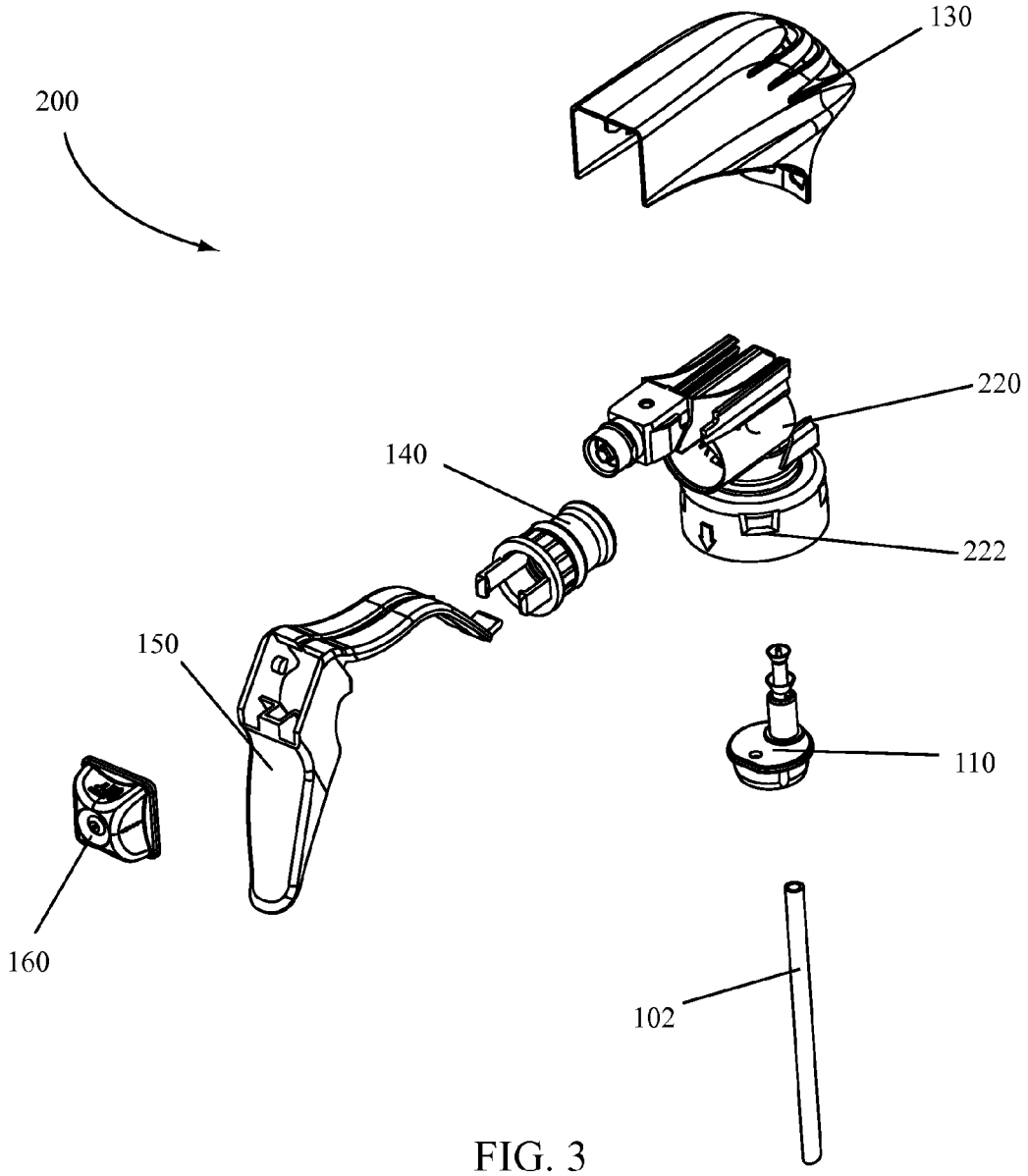
FIG. 3 illustrates various components of a trigger sprayer assembly according to various embodiments of the invention.

According to other embodiments of the invention, a trigger sprayer 200 may include different components for attaching the trigger sprayer 200 to a container, such as a bayonet system. For example, a trigger sprayer 200 incorporating a bayonet system as a closure mechanism is illustrated in FIG. 3. A trigger sprayer 200 may include a valve body 220, a tube retainer 110, a piston 140, a trigger 150 and a shroud 130. The trigger sprayer 200 may also include a nozzle 160. The valve body 220 of the trigger sprayer 200 may include bayonet features molded integrally with the valve body 220 such that the valve body may be attached directly to a container having reciprocal bayonet features. For example, as illustrated in FIG. 3, valve body 220 may include one or more lug receptacles 222 for receiving one or more lugs on a container such that the lugs and lug receptacles 222 secure the trigger sprayer 200 to a container. Any bayonet system or design may be used with various embodiments of the invention as desired. The use of a bayonet system with a trigger sprayer 200 may eliminate the need for a closure 106 and gasket 104 as illustrated in FIG. 1, thereby reducing the part count and the assembly requirements for the trigger sprayer 200.

Figure 4:
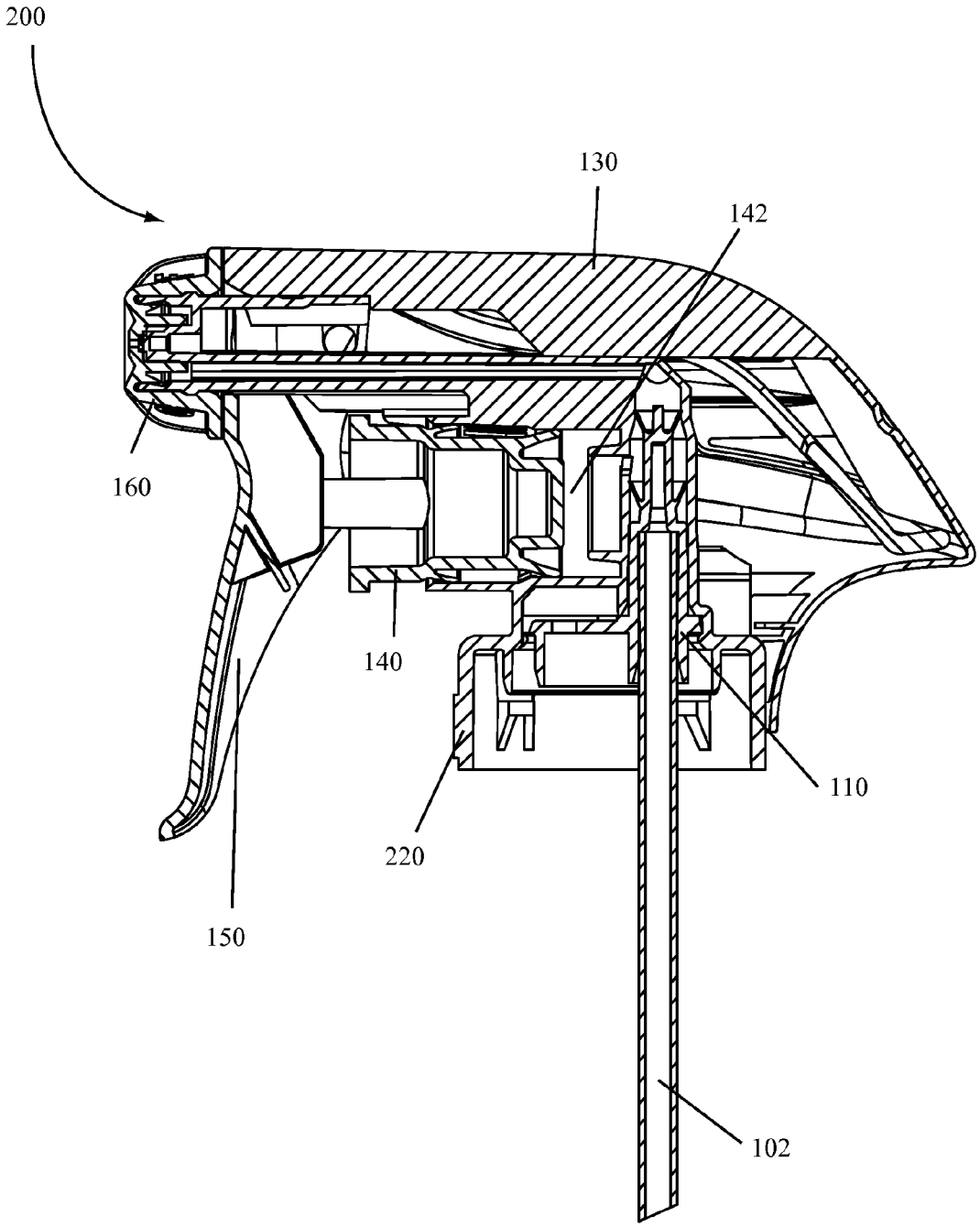
FIG. 4 illustrates a cross-sectional side view of an assembled trigger sprayer according to various embodiments of the invention.

A cross-sectional side view of an assembled trigger sprayer 200 using the components illustrated in FIG. 3 is illustrated in FIG. 4. As illustrated, the tube retainer 110 fits within the valve body 220 and may be inserted in a flow passage of the valve body 220. A portion of the piston 140 also fits within a portion of the valve body 220, forming a pump chamber 142 in the volume between the piston 140 and the valve body 220. The piston 140 may also be connected to the trigger 150. Movement of the trigger 150 may translate into movement of the piston 140 within the valve body 220. The shroud 130 may fit over a portion of the valve body 220 and may be attached to or fixed on the valve body 220 as desired. The valve body 220 may include bayonet features for attaching the trigger sprayer 200 to a container or other device.

Figure 5:
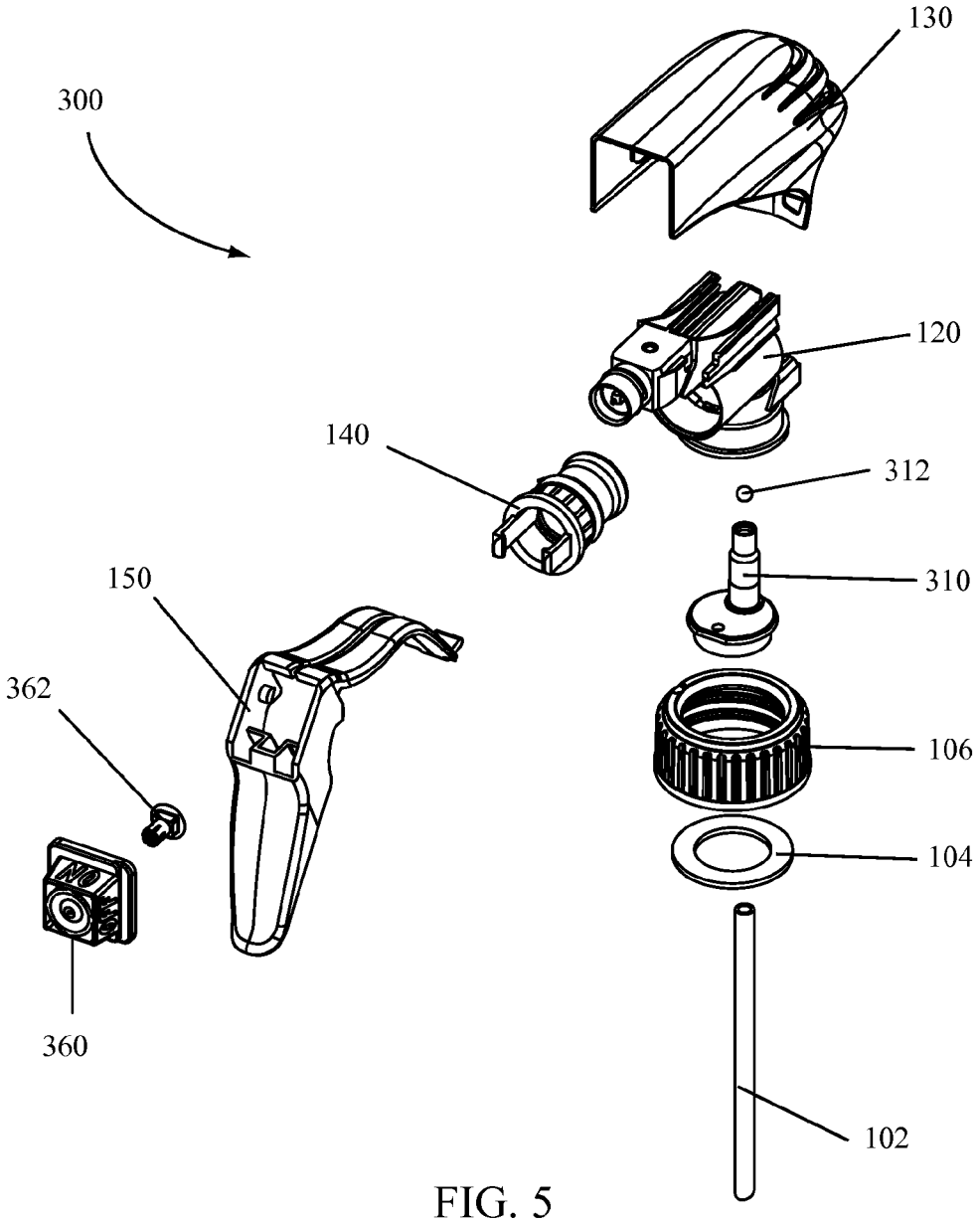
FIG. 5 illustrates various components of a trigger sprayer assembly according to various embodiments of the invention.

An alternative version of a trigger sprayer 300 according to embodiments of the invention is illustrated in FIG. 5. The trigger sprayer 300 is similar to the trigger sprayer 100 illustrated in FIG. 1 with the exception that the tube retainer 110 of trigger sprayer 100 is substituted with a tube retainer 310 and ball 312 combination and the and nozzle 160 of trigger sprayer 100 is substituted with a nozzle 360 and nozzle insert 362 as illustrated. According to certain embodiments of the invention, a trigger sprayer 300 may include a conventional tube retainer 310 and ball 312 incorporated with a valve body 120, piston 140, trigger 150, and shroud 130. Similarly, a nozzle 360 and nozzle insert 362 may be substituted for the nozzle 160 illustrated in FIG. 1. The nozzle 360 and nozzle insert 362 combination may be substituted to provide different spin mechanics for the trigger sprayer 300 or may be used with different valve bodies 120 to impart different spin mechanics to a product being sprayed from the trigger sprayer 300.

Figure 6:
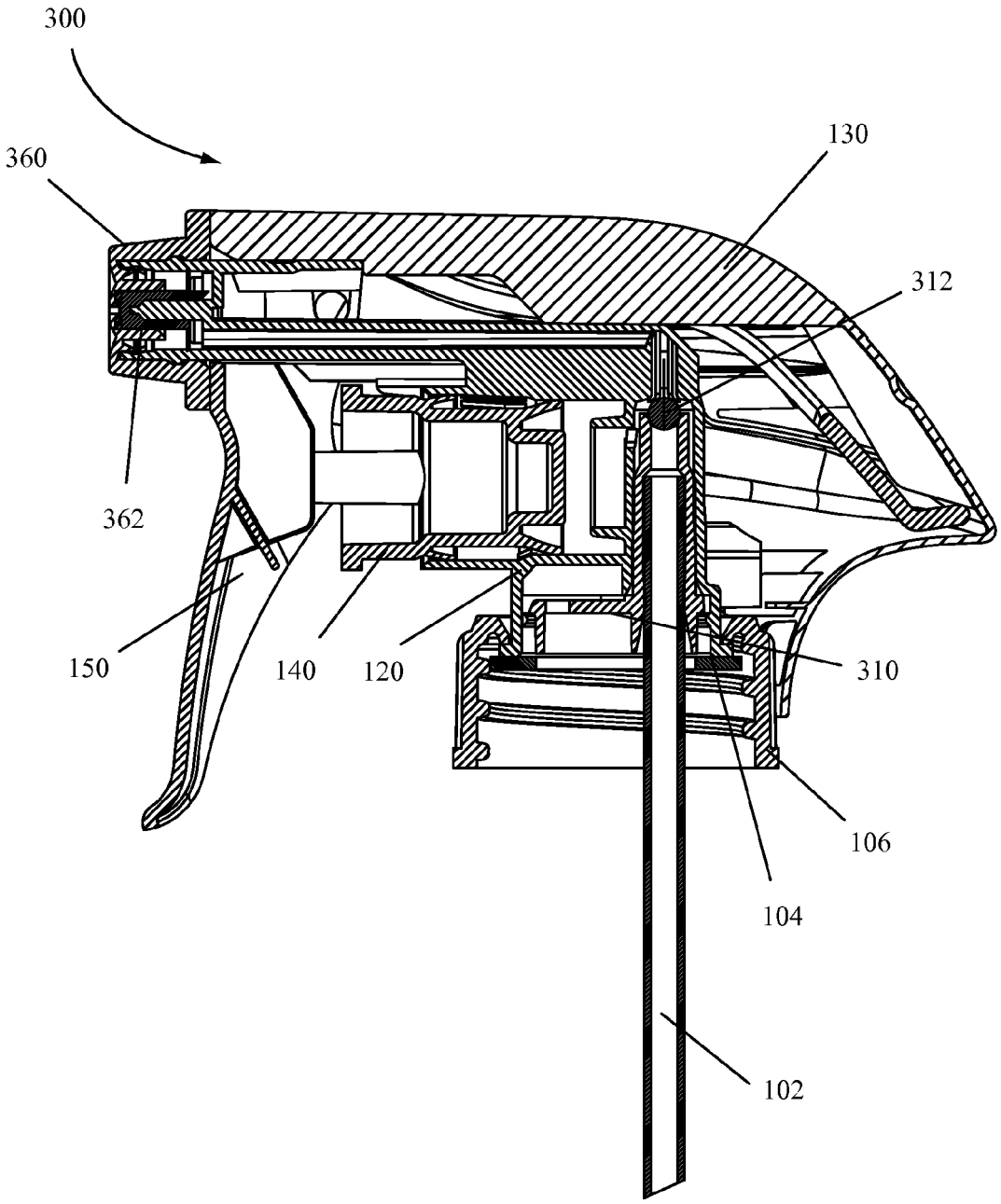
FIG. 6 illustrates a cross-sectional side view of an assembled trigger sprayer according to various embodiments of the invention.

A cross-sectional side view of an assembled trigger sprayer 300 using the components illustrated in FIG. 5 is illustrated in FIG. 6. As illustrated, the tube retainer 310 fits within the valve body 120 and may be inserted in a flow passage of the valve body 120. The tube retainer 310 may support a ball 312 which acts as a check valve for the trigger sprayer 300. A portion of the piston 140 fits within a portion of the valve body 120, forming a pump chamber 142 in the volume between the piston 140 and the valve body 120. The piston 140 may also be connected to the trigger 150. Movement of the trigger 150 may translate into movement of the piston 140 within the valve body 120. The shroud 130 may fit over a portion of the valve body 120 and may be attached to or fixed on the valve body 120 as desired. A nozzle insert 362 may fit between the valve body 120 and a nozzle 360 attached to and end of the valve body 120. The nozzle 360 and nozzle insert 362 may dictate the spin mechanics used with the trigger sprayer 300. As desired, different nozzle inserts 362 may be combined with nozzles 360 to achieve a desired spin mechanics or spray pattern for the trigger sprayer 300.

Figure 7:
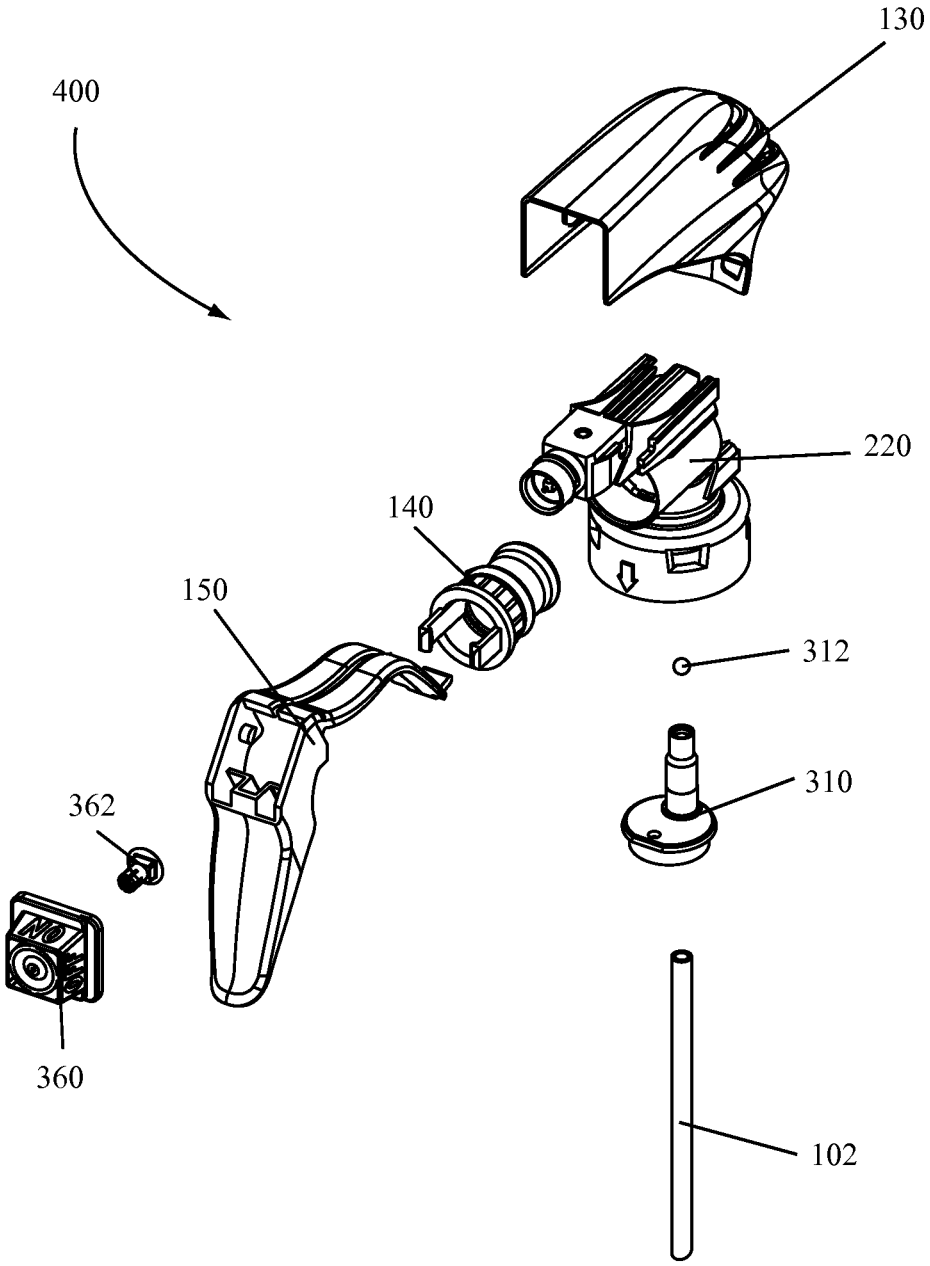
FIG. 7 illustrates various components of a trigger sprayer assembly according to various embodiments of the invention.

Similarly, a bayonet version of a trigger sprayer 400 may incorporate a tube retainer 310 and ball 312 as illustrated in FIG. 7. A nozzle 360 and nozzle insert 362 may also be incorporated with or substituted for the nozzle 160 of trigger sprayer 200.

Figure 8:
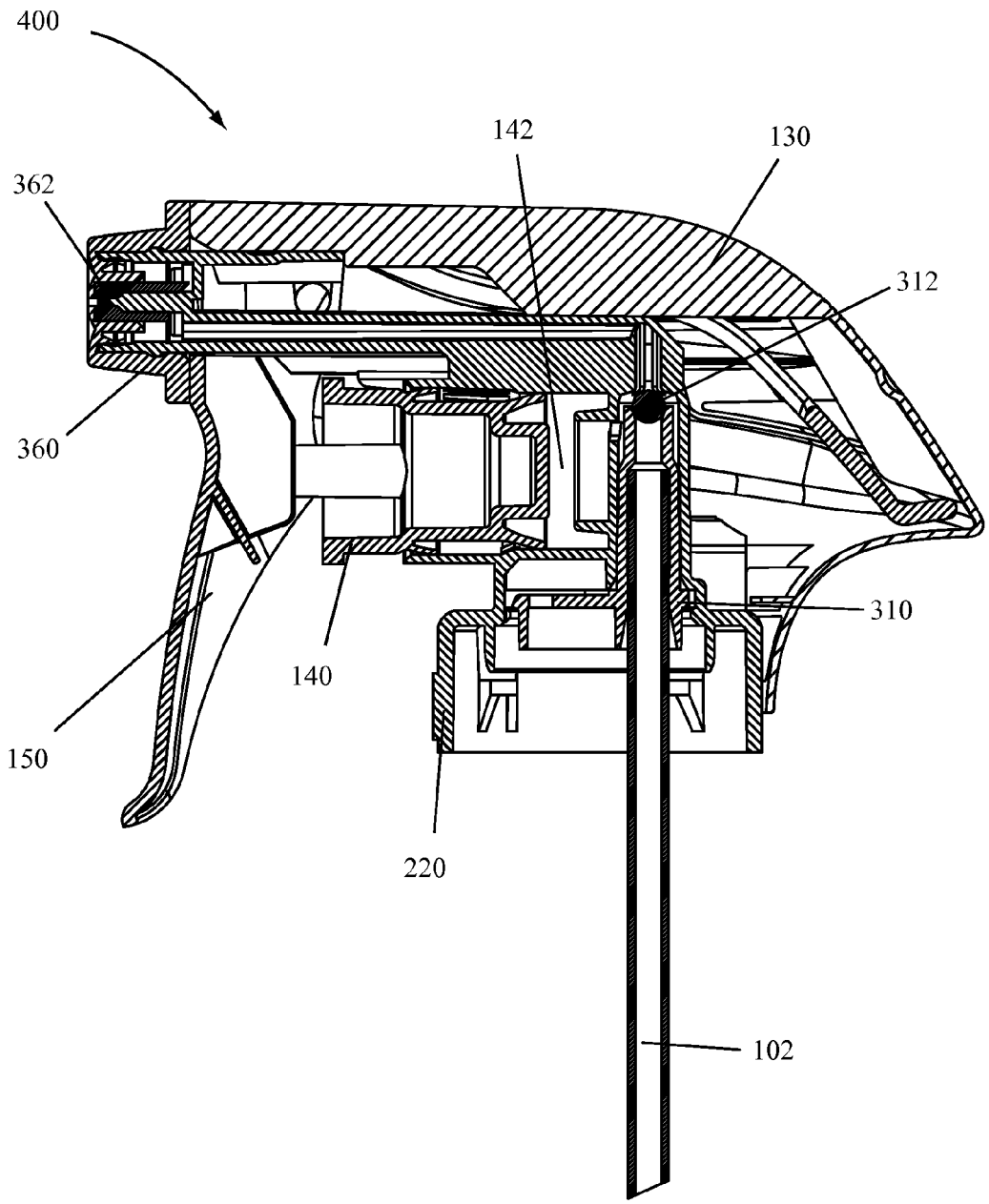
FIG. 8 illustrates a cross-sectional side view of an assembled trigger sprayer according to various embodiments of the invention.

A cross-sectional side view of an assembled trigger sprayer 400 using the components illustrated in FIG. 7 is illustrated in FIG. 8. As illustrated, the tube retainer 310 fits within the valve body 220 and may be inserted in a flow passage of the valve body 220. A portion of the piston 140 also fits within a portion of the valve body 220, forming a pump chamber 142 in the volume between the piston 140 and the valve body 220. The piston 140 may also be connected to the trigger 150. Movement of the trigger 150 may translate into movement of the piston 140 within the valve body 220. The shroud 130 may fit over a portion of the valve body 220 and may be attached to or fixed on the valve body 220 as desired. A nozzle insert 362 may fit between the valve body 220 and a nozzle 360 attached to and end of the valve body 220. The nozzle 360 and nozzle insert 362 may dictate the spin mechanics used with the trigger sprayer 400. As desired, different nozzle inserts 362 may be combined with nozzles 360 to achieve a desired spin mechanics or spray pattern for the trigger sprayer 400.

According to various embodiments of the invention, a trigger sprayer may include a valve body, a tube retainer, a piston 140, a trigger 150, and a shroud 130. A valve body may include a valve body 120 as illustrated in FIGS. 1 and 5 or a valve body 220 as illustrated in FIGS. 3 and 7. Likewise, a tube retainer may include a tube retainer 110 as illustrated in FIGS. 1 and 3 or a tube retainer 310 and ball 312 as illustrated in FIGS. 5 and 7. A nozzle 160 or a nozzle 360 and nozzle insert 362 may also be used with a trigger sprayer according to any embodiments of the invention.

Figure 9:
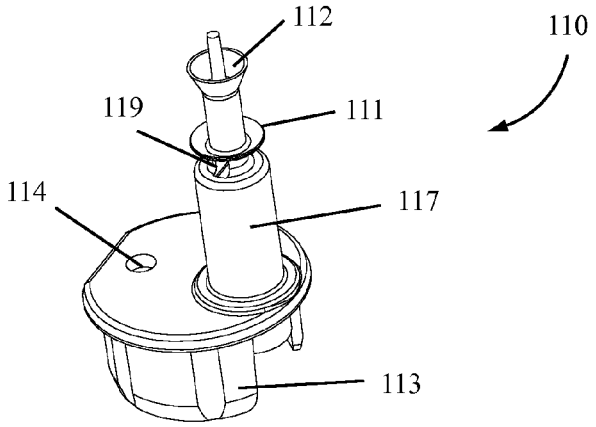
FIG. 9 illustrates a tube retainer according to various embodiments of the invention.
Figure 10:
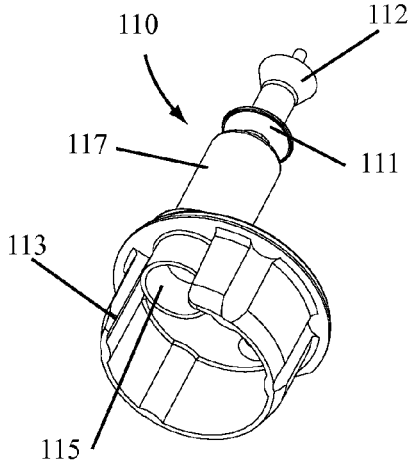
FIG. 10 illustrates a tube retainer according to various embodiments of the invention.
Figure 11:
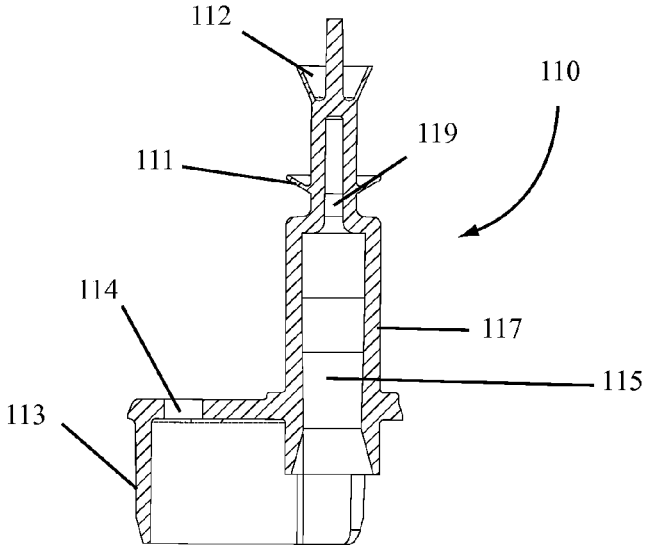
FIG. 11 illustrates a cross-sectional view of a tube retainer according to various embodiments of the invention.

A tube retainer 110 according to various embodiments of the invention is illustrated in FIGS. 9 through 11. FIGS. 9 and 10 provide perspective views of a tube retainer 110 and FIG. 11 illustrates a cross-sectional view of a tube retainer 110 according to various embodiments of the invention.

A tube retainer 110 may include a tube receptacle 115 having an exterior wall 117. The tube receptacle 115 may be cylindrical and may include features for retaining a dip-tube 102 within a portion of the tube receptacle 115. For example, as illustrated in the cross-sectional view of the tube receptacle 115 in FIG. 11, tube receptacle 115 may include a flared opening in a bottom portion of the tube retainer 110 for assisting with the reception of a dip-tube 102 into the tube retainer 110 during assembly. The tube receptacle 115 may also include flared walls or angled walls which help prevent a dip-tube 102 from being pulled out of the tube retainer 110 once inserted. Other features, such as notches, bumps, teeth or other features may be included within the tube receptacle 115 to assist with holding a dip-tube 102 therein.

A plug seal 113 may encompass at least a portion of one end of the tube retainer 110 as illustrated in FIGS. 9 through 11. The plug seal 113 may interface with or contact a container to which a trigger sprayer 100 is attached. A top shelf overlying the plug seal 113 may include one or more vent holes 114 as illustrated. The top shelf overlying the plug seal 113 may also extend sufficiently outward from the plug seal 113 as desired. The tube retainer 110 may also include a skirt for retaining a gasket 104 for certain closure systems. The exterior wall 117 of the tube receptacle 115 may extend away from an upper portion of the top shelf.

A tube retainer 110 according to embodiments of the invention may include two integral valves: an inlet valve 111 and an outlet valve 112. The inlet valve 111 and outlet valve 112 may be molded with the tube retainer 110, thereby reducing the part count of the trigger sprayer 100. According to embodiments of the invention, the inlet valve 111 and outlet valve 112 may be conical in shape. Other shapes and configurations of the inlet valve 111 and outlet valve 112 may also be used as desired. The inlet valve 111 and outlet valve 112 may also be pliable or moveable such that pressure asserted against a lower surface of either the inlet valve 111 or outlet valve 112 may move the material of the respective valve.

One or more inlet passages 119 may also be molded into the tube retainer between the exterior wall 117 and the interior of the tube receptacle 115. An inlet passage 119 may be positioned between the inlet valve 111 and the plug seal 113 of the tube retainer 110. The inlet passage may allow a product or fluid to pass from within the tube receptacle 115 through the tube retainer 110 wall and into a portion of a trigger sprayer 100. As illustrated in FIG. 11, fluid or product flowing from within the tube receptacle 115 and out inlet passage 119 exits the inlet passage 119 just below one end of the inlet valve 111.

According to other embodiments of the invention, a tube retainer 310 may include any conventional tube retainer 310 and ball 312 which acts as a check valve in the trigger sprayer as illustrated in FIGS. 5 through 8. A ball 312 used with embodiments of the invention may include a steel ball, a metal ball, a plastic ball, a glass ball, or a ball made of any other desirable material.

Other tube retainer designs may also be incorporated with various embodiments of the invention as needed. Alternatively, embodiments of the invention may also include conventional trigger sprayer valving means and fluid flow means for delivering a product or fluid into and through a trigger sprayer.

A valve body according to embodiments of the invention may be configured for closure systems as illustrated in FIGS. 1 and 5 or configured for bayonet-type closure systems as illustrated in FIGS. 3 and 7. The lower portion of a valve body may differ depending upon the type of closure being used with a trigger sprayer 100. While various features of the valve body are described with respect to the valve body 120 illustrated in FIGS. 1 and 5, it is understood that similar features may be incorporated with valve body 220 illustrated in FIGS. 3 and 7 or with any other valve body used with embodiments of the invention.

Figure 12:
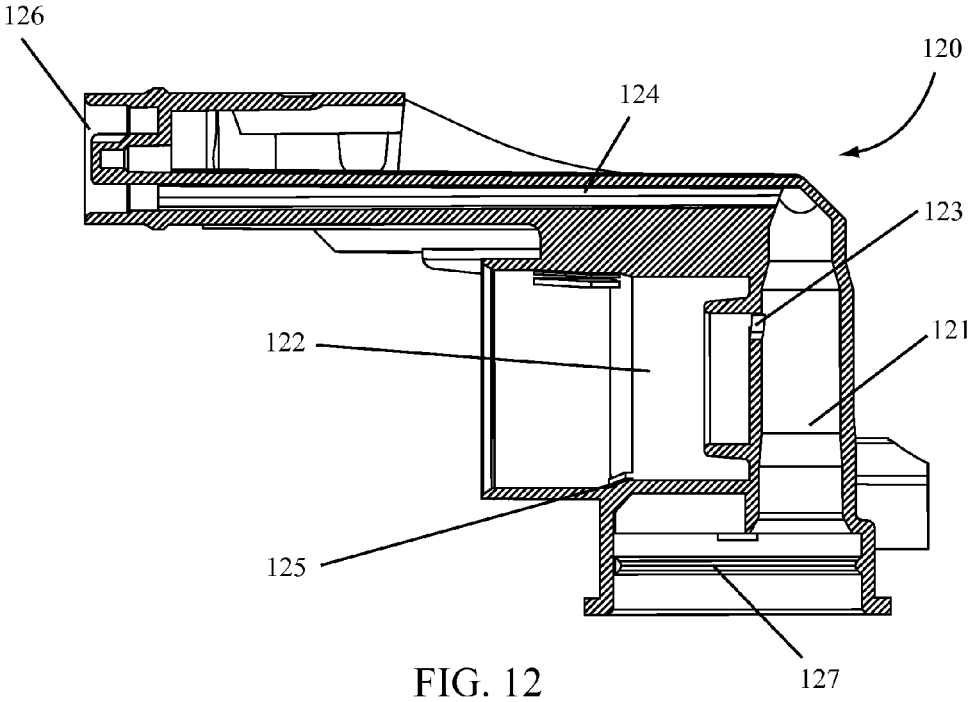
FIG. 12 illustrates cross-sectional view of a valve body according to various embodiments of the invention.

A cross-sectional view of a valve body 120 according to embodiments of the invention is illustrated in FIG. 12. A valve body 120 may include a tube retainer opening 121, a fluid passageway 123, a piston opening 122, and a discharge passageway 124. In some embodiments of the invention, spin mechanic features 126 may be cored or formed in an end of the valve body 120 as illustrated in FIG. 12. A snap ring 127 or other feature for retaining a tube retainer 110 in the valve body 120 may also be included on the valve body 120. The piston opening 122 may also include ramps 125 or other features to assist with the movement of a piston 140 within the piston chamber 122 or to assist with venting the trigger sprayer 100.

According to embodiments of the invention, a tube retainer 110 may be fitted with or secured in the valve body 120. For example, the exterior wall 117 of the tube retainer 110 may be configured to fit within the tube retainer opening 121 of the valve body 120. Once in position, a snap ring 127 or other feature may hold the tube retainer 110 in the valve body 120. Other methods for retaining a tube retainer 110 in the valve body 120 may also be used. When seated or secured in the valve body 120, the fluid passageway 123 may be positioned between the inlet valve 111 and outlet valve 112 of the tube retainer 110.

A piston 140 may be mounted or moveably positioned within the piston opening 122 of the valve body 120. When mounted in the valve body 120, space in the piston opening 122 between the piston 140 and the valve body 120 may form a pump chamber 142. Movement of the piston 140 within the piston opening 122 may vary the volume of the pump chamber 142 and may act to push and pull a product or fluid into and out of the pump chamber 142.

A nozzle 160 or a nozzle 360 and nozzle insert 362 may be attached to an end of the valve body 120 which end may include spin mechanic features 126.

Figure 13:
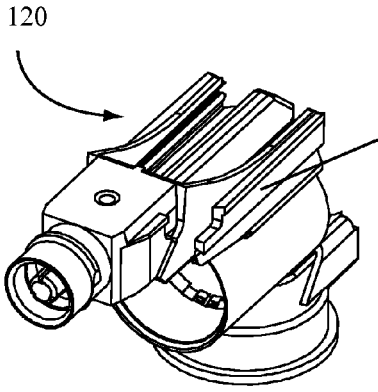
FIG. 13 illustrates a valve body according to various embodiments of the invention.
Figure 14:
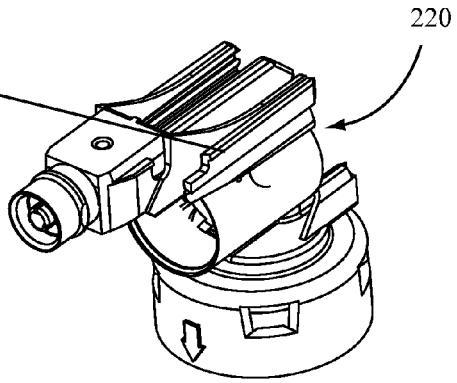
FIG. 14 illustrates a valve body according to various embodiments of the invention.
Figure 19:
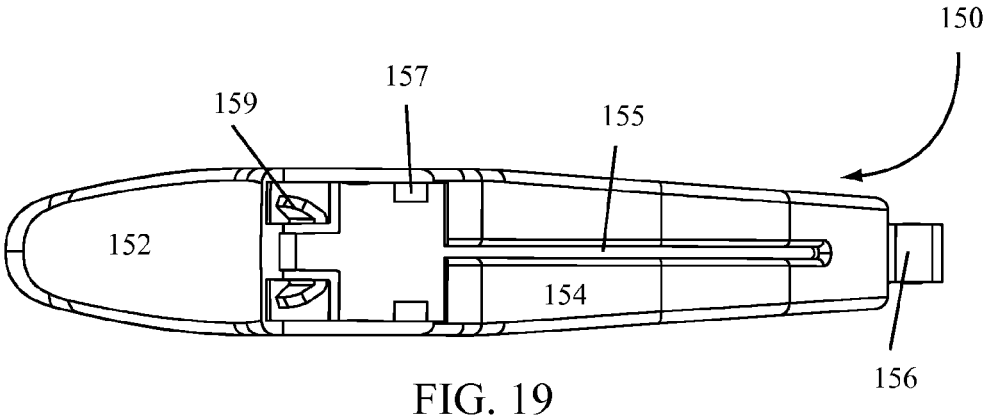
FIG. 19 illustrates a top-down view of a trigger according to various embodiments of the invention.
Figure 20:
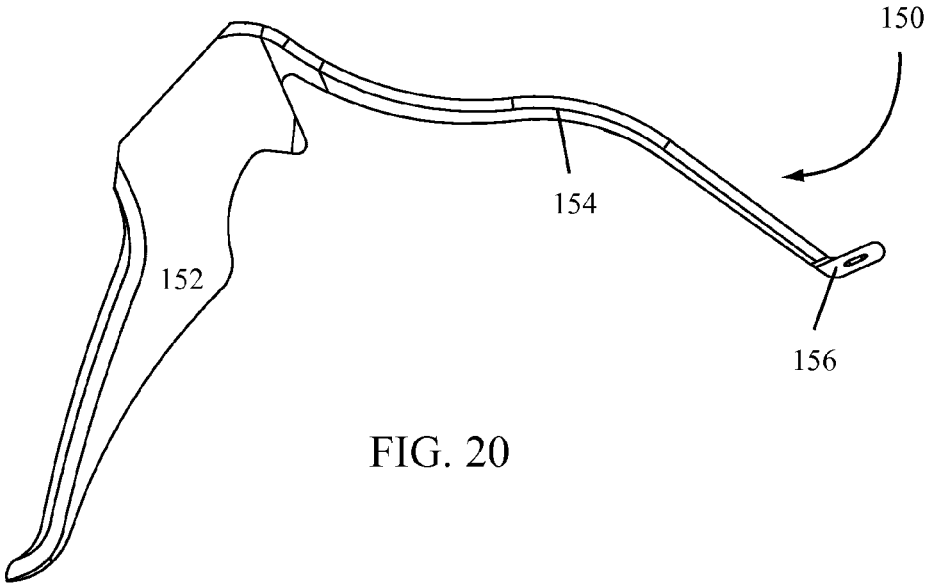
FIG. 20 illustrates a side-view of a trigger according to various embodiments of the invention.
Figure 21:
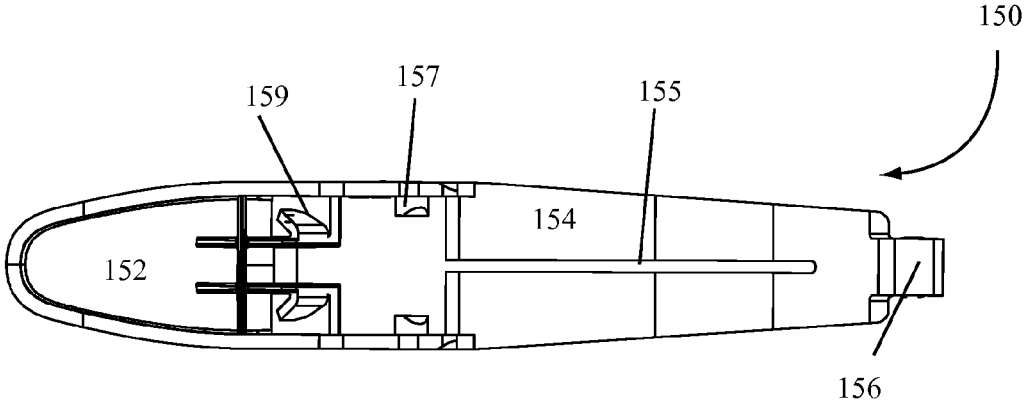
FIG. 21 illustrates a bottom-up view of a trigger according to various embodiments of the invention.
Figure 22:
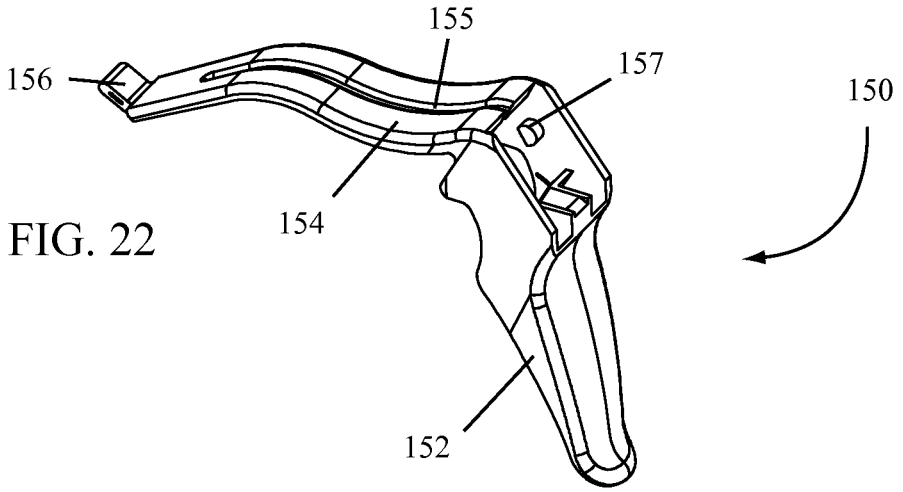
FIG. 22 illustrates a perspective view of a trigger according to various embodiments of the invention.
Figure 23:
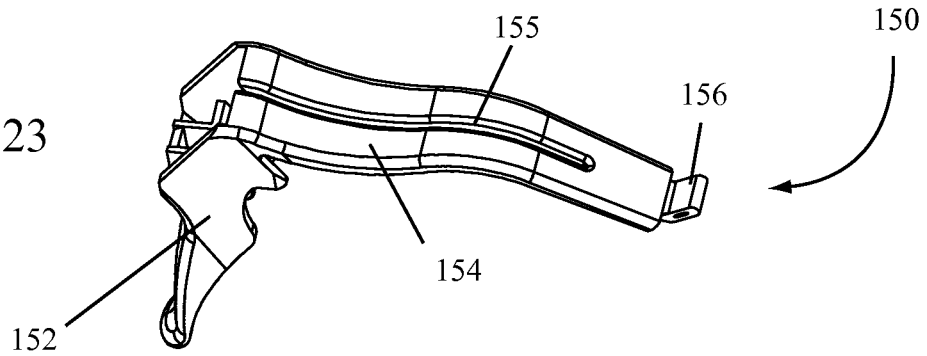
FIG. 23 illustrates a perspective view of a trigger according to various embodiments of the invention.
Figure 24:
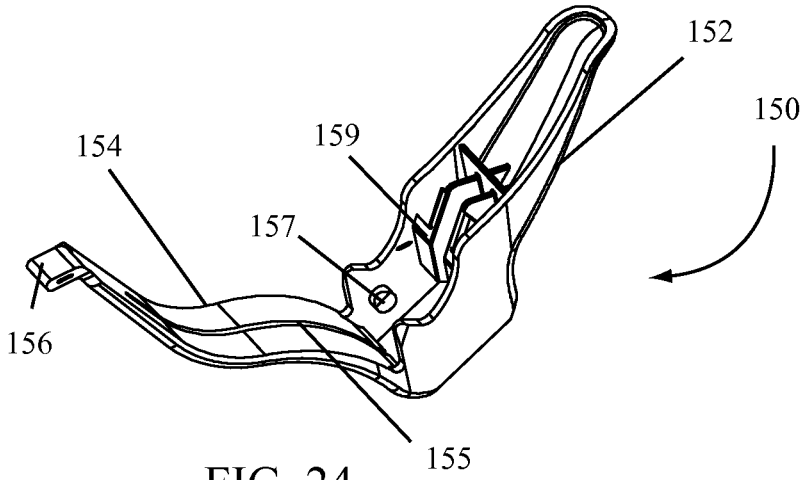
FIG. 24 illustrates a perspective view of a trigger according to various embodiments of the invention.
Figure 25:
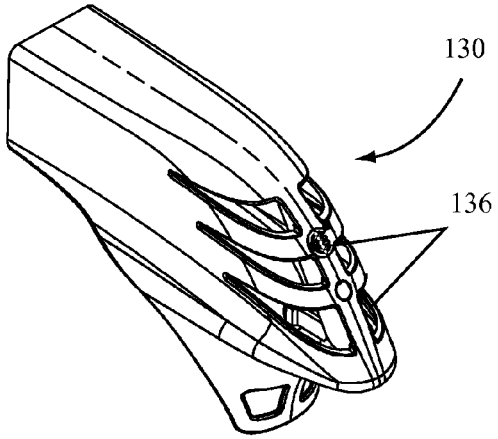
FIG. 25 illustrates a shroud according to various embodiments of the invention.
Figure 26:
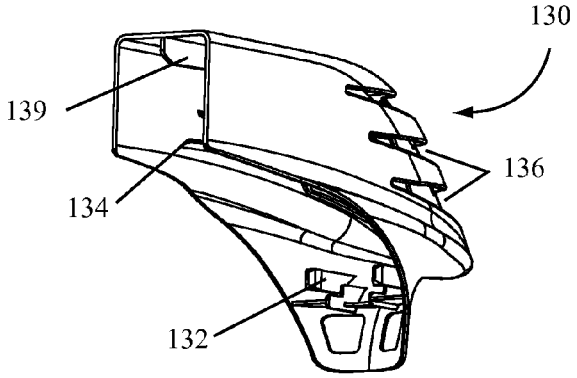
FIG. 26 illustrates a shroud according to various embodiments of the invention.
Figure 27:
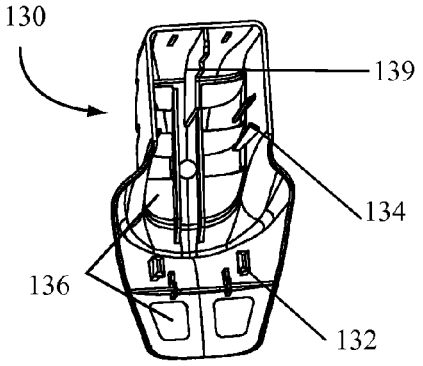
FIG. 27 illustrates a shroud according to various embodiments of the invention.

In some embodiments of the invention, the valve body 120 may also include features to secure a shroud 130 to the valve body 120 or which improve the fit between the valve body 120 and a shroud 130 mounted on or secured to the valve body 120. For example, rails 129 on a valve body such as the valve body 120 and valve body 220 illustrated in FIGS. 13 and 14 may help secure a shroud 130 to the valve body. The rails 129 may also help reduce noise generated by rubbing or flexing of the shroud 130 and valve body during actuation of a trigger sprayer 100.

Other valve body 120 designs may also be incorporated with various embodiments of the invention as needed. Alternatively, embodiments of the invention may also include conventional trigger sprayer valve body configurations.

A nozzle 160 according to embodiments of the invention is illustrated in FIGS. 15 and 16. FIG. 15 illustrates a front perspective view of a nozzle 160 according to embodiments of the invention and FIG. 16 illustrates a rear perspective view of the same nozzle 160. A nozzle 160 may be configured to mate with the spin mechanic features 126 of a valve body 120 to produce a desired spray pattern for fluid or product exiting the trigger sprayer 100. Any desired nozzle 160 or nozzle 360 and nozzle insert 362 combination may be used with embodiments of the invention.

A piston 140 according to embodiments of the invention is illustrated in FIGS. 17 and 18. FIG. 17 illustrates a top-down view of a piston 140 and FIG. 18 illustrates a cross-sectional view of a piston 140 according to embodiments of the invention.

A piston 140 according to embodiments of the invention may include one or more arms 145 for connection to a trigger 150. For example, the piston 140 illustrated in FIGS. 17 and 18 includes two arms 145 having snap attachments at an end thereof for connecting to a trigger 150. In other embodiments, a piston 140 may have one arm 145 or more than two arms 145.

According to embodiments of the invention, a piston 140 having two arms 145 may be advantageous because the presence of two arms 145 allows the piston 140 to be molded without the use of side actions and provides improved cooling of the piston 140 in the mold which allows for a reduced part production or cavitation time. Thus, the piston 140 illustrated in FIGS. 17 and 18 may be made quicker than other pistons 140, thereby reducing the overall costs associated with the piston 140.

A piston 140 may also include one or more piston flanges 147 which may provide improved sealing between the piston 140 and an interior of the valve body 120 piston opening 122. The one or more flanges 147 may also assist with the venting of the trigger sprayer 100.

Alternative or conventional piston 140 designs may also be used with embodiments of the invention and different features and methods for attaching the piston 140 to a trigger 150 may be used.

A trigger 150 according to embodiments of the invention is illustrated in FIGS. 19 through 24. According to embodiments of the invention, a trigger 150 may include a trigger lever 152 and an integrated spring or biasing member 154. The trigger lever 152 may be shaped or configured for actuation of the trigger 150. In certain embodiments of the invention, the trigger lever 152 and biasing member 154 may be molded as an integral or unitary component. For example, the trigger 150 may include a unitary molded plastic part including both a trigger lever 152 and a biasing member 154. In some embodiments, the trigger 150 may be molded from a plastic material such as a polypropylene material.

According to embodiments of the invention, a trigger 150 may include one or more piston attachment features 159. As illustrated, piston attachment features 159 may include arced clips or features configured to mate with a snap attachment or other feature of a piston arm 145. The snap attachments of the piston arms 145 illustrated in FIGS. 17 and 18 may snap into or otherwise slide between the piston attachment features 159 and a backside of the trigger lever 152 such that the piston arms 145 are secured to the trigger 150. As the trigger 150 of a trigger sprayer 100 is actuated, the snap attachments or other features of the piston arm 145 may be secured to the trigger 150 by the piston attachment features 159. Movement of the trigger 150 may translate into movement of the piston 140 within the piston opening 122 of the valve body 120. In this way, the pump chamber 142 volume may be varied and a fluid or product pumped through the trigger sprayer 100. In some embodiments of the invention, an arced connection between the piston arm 145 and the piston attachment features 159 allows for a smooth movement of the trigger lever 152 during actuation of the trigger 150. An arced connection may allow the piston 140 to move horizontally as the trigger 150 is actuated.

A trigger 150 may include one or more posts 157 which may be configured to mate with a hole or other feature on a valve body 120. For example, the one or more posts 157 may fit into holes in a valve body 120 such that the trigger 150 is supported or secured to the valve body 120 by the mating of the one or more posts 157 with the valve body 120. Other connection means may also be used to help secure a trigger 150 to a valve body 120.

The window in the trigger 150 between the trigger lever 152 and the biasing member 154 may allow easy molding of the trigger 150. For instance, the illustrated trigger 150 may be molded in a single action mold, which may reduce complicated molding and molding costs.

A biasing member 154 according to embodiments of the invention is molded or is integral with the trigger lever 152. The biasing member 154 may act as a spring when attached to or when working in conjunction with any one or more of a valve body 120 and shroud 130. The shape of the biasing member 154 may be altered to achieve a desired force or spring force for actuation of a trigger 150. For example, the biasing member 154 illustrated in FIG. 20 includes tapers in two directions; the taper in two different directions may reduce stresses on the biasing member 154 and may prolong the life of the biasing member 154. The shape of the biasing member 154 may also be configured to fit within a desired height to facilitate modification or design of a shroud 130 incorporated with a trigger sprayer 100.

A slot 155 in the biasing member 154 may aid in the function of the biasing member 154. The slot 155 may be configured to alter a biasing force provided by the biasing member 154 during actuation of a trigger 150. The slot 155 may also facilitate the assembly of a trigger 150. For example, the trigger 150 illustrated in FIGS. 19 through 24 may be assembled with a valve body 120 such as that illustrated in FIGS. 12 through 14. During assembly, the trigger 150 may be attached or mated with a front portion of the valve body 120 such that the one or more posts 157 snap into holes on the valve body 120. As the trigger 150 is pushed onto the valve body 120 so that the one or more posts 157 can mate with holes in the valve body 120, the trigger 150 must be able to flex or expand to allow such attachment. The presence of slot 155 in the biasing member 154 allows the trigger 150, and particularly the biasing member 154, to flex and expand so that the one or more posts 157 may fit around the valve body 120 and into holes on the valve body 120.

A bias wing 156 may be attached to or an integral part of a trigger 150. As illustrated in FIGS. 19 through 24, the bias wing 156 may extend off a back portion of the biasing member 154 of the trigger 150. The bias wing 156 may interact with any one or more of the valve body 120 or shroud 130 to facilitate the biasing of the bias member 154 during actuation of a trigger 150.

In other embodiments of the invention, the trigger lever 152 may include a loop or other feature which may allow a user to assist with the return of the trigger lever 152 to a starting position in the event that the biasing member 154 is damaged, worn out, or breaks. A loop or other feature may also assist with the return of a trigger lever 152 during normal actuation as desired.

A shroud according to embodiments of the invention is illustrated in FIGS. 25 through 30. While the aesthetics of the shroud 130 illustrated in FIGS. 25 through 30 may be used with various embodiments of the invention, other aesthetics may also be used as desired and the shroud 130 features may be incorporated with such aesthetics.

According to embodiments of the invention, a shroud 130 may include one or more valve body attachments 132. A valve body attachment 132 may mate with a feature on a valve body 120 to help secure the shroud 130 to the valve body 120. Any desired combination of valve body attachments 132 may be used with a shroud 130 to secure the shroud 130 to a valve body 120.

A shroud 130 may also include one or more valve body ribs 134. A valve body rib 134 may mate with or help secure a valve body 120 to the shroud 130 during assembly. A valve body rib 134 may also help guide a shroud 130 onto a valve body 120, or a valve body 120 into a shroud 130, during assembly processes. According to some embodiments of the invention, a valve body rib 134 may provide extra contact between the valve body 120 and the shroud 130 whereby noises generated by the movement and flexing of the trigger sprayer 100 during actuation are reduced or minimized.

In some embodiments of the invention, a shroud 130 may include one or more windows 136. A window 136 may be configured to allow a user to see movement of the biasing member 154 through the shroud 130 during actuation of the trigger 150. In some embodiments, the biasing member 154 and shroud 130 may be different colors, thereby highlighting any movement of the biasing member 154 against the shroud 130. The presence of one or more windows 136 may also reduce the weight of the shroud 130 and thereby reduce the cost of the shroud 130. Windows 136 may also be positioned or used to facilitate assembly of a trigger 150.

A shroud 130 may also include one or more supports 139 within the shroud 130. The one or more supports 139 may mate with or contact a valve body 120 and may provide support for the shroud 130 and the trigger 150. For example, the support 139 illustrated in FIGS. 26 through 30 may contact the valve body 120 when assembled such that the support 139 provides top-loading support for the trigger sprayer 100. The use of one or more supports 139 may also enable the shroud 130 to be made with thinner walls, resulting in the use of less material and a potential cost savings. The use of one or more supports 139 may also facilitate distribution of forces on the trigger sprayer 100 during the assembly process. For instance, the one or more supports 139 may support the shroud 130 such that a dip-tube 102 may be inserted into a tube retainer 110 of an assembled trigger sprayer 100 without damage to the trigger sprayer 100.

In some embodiments of the invention, one or more slots 155 in the bias member 154 may be positioned such that the one or more supports 139 fit through the one or more slots 155 to contact the valve body 120. The positioning of the one or more slots 155 and the one or more bias members 154 may facilitate the assembly of a trigger sprayer 100 or the biasing of the biasing member 154 of the trigger 150 during actuation of the trigger sprayer 100.

Figure 28:
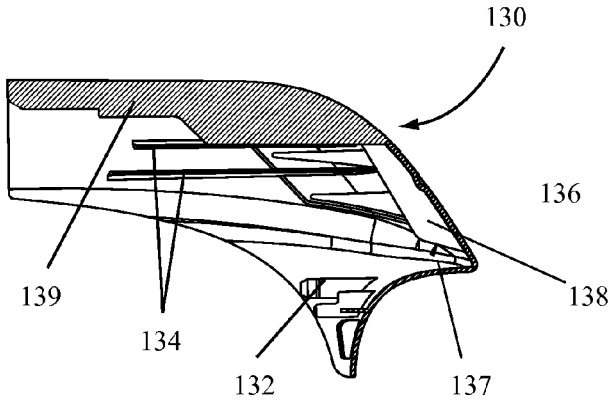
FIG. 28 illustrates a cross-sectional view of a shroud according to various embodiments of the invention.
Figure 29:
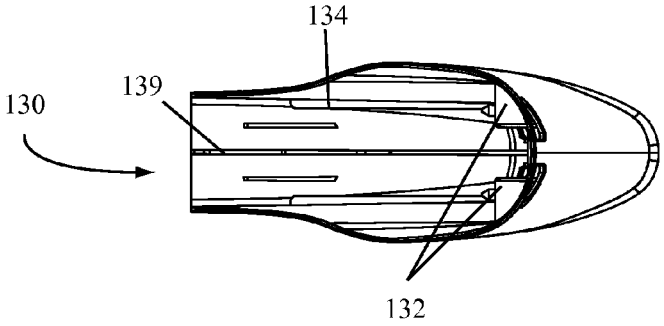
FIG. 29 illustrates a shroud according to various embodiments of the invention.
Figure 30:
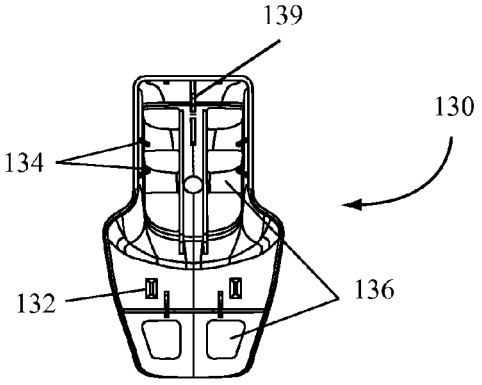
FIG. 30 illustrates a shroud according to various embodiments of the invention.

As illustrated in the cross-sectional view of shroud 130 in FIG. 28, a shroud 130 according to embodiments of the invention may also include one or more bias member guides 138. A bias member guide 138 may be shaped or configured to accept a portion of the biasing member 154 of the trigger 150. Alternatively, the bias member guide 138 may be shaped or configured to accept a portion of the bias wing 156 of the trigger 150. For example, as illustrated in FIG. 28, a space exists between the bias member guide 138 and a bottom rear portion 137 of the shroud 130. A trigger 150 according to embodiments of the invention, may be assembled with a valve body 120 and a shroud 130 such that the bias wing 156 is positioned between the bias member guide 138 and the bottom rear portion 137 of the shroud 130. For instance, the bias wing 156 of the trigger 150 in FIGS. 2, 4, 6, and 8 is so positioned. In addition, the bias wing 156 of the trigger 150 may contact the bias member guide 138 and may move along the bias member guide 138 during actuation of the trigger 150. Movement of the bias wing 156 along the bias member guide 138 facilitates flexion and compression of the biasing member 154 portion of the trigger 150.

According to embodiments of the invention, the bias member guide 138 and interaction with the bias wing 156 or other portion of the biasing member 154 of the trigger 150 may be engineered to provide particular characteristics of the biasing member 154. Further, the use of a sliding biasing member 154, or free floating biasing member 154, may allow alterations in the design of a trigger sprayer 100.

In still other embodiments of the invention, the bias member guide 138 may facilitate the assembly of a trigger sprayer 100. For instance, as a shroud 130 is assembled to a valve body 120 and trigger 150 combination, the bias member guide 138 may direct or move the bias wing 156 into a proper position within the shroud 130 to allow actuation of the trigger sprayer 100 as desired.

According to embodiments of the invention, a trigger sprayer 100 may be assembled by inserting a tube retainer 110 into a valve body 120. A piston 140 may be assembled in the valve body 120 and a trigger 150 assembled to the valve body 120 such that the piston 140 is also attached to the trigger 150. A shroud 130 may be assembled to the valve body 120 and a bias wing 156 of the trigger 150 may follow a bias member guide 138 to the proper location within the shroud 130.

According to embodiments of the invention, the biasing member 154 of the trigger 150 may move freely within the shroud 130 along the bias member guide 138. In this manner, the bias member 154 is not attached to the valve body 120 but is free floating within the trigger sprayer 100. In addition, the bias member 154 may act against the shroud 130 rather than against the valve body 120 to move a piston 140 and fill a pump chamber 142.

According to embodiments of the invention, a trigger sprayer 100 or trigger sprayer 200 having a tube retainer 110 with both an inlet valve 111 and an outlet valve 112 as illustrated in FIGS. 1 through 4 may operate as follows. Actuation of the trigger 150 moves the piston 140 within the valve body 120, decreasing the size of the pump chamber 142. As the trigger 150 is actuated, the bias member 154 flexes and the bias wing 156 moves along bias member guide 138, allowing the bias member 154 to deform within the confines of the shroud 130. Release of the trigger lever 152 allows bias member 154 to return to its original shape, thereby pulling piston 140 away from the valve body 120 and increasing the volume of the pump chamber 142. As the piston 140 moves out of the valve body 120, a pressure difference is formed within the pump chamber 142 which results in a pressure difference being applied through the fluid passageway 123. This results in the drawing of a product from a container through the tube retainer 110 and out one or more inlet passages 119 in the tube retainer 110. Fluid passing through the one or more inlet passages 119 is drawn by the inlet valve 111 due to the pressure difference and through the fluid passageway 123 into the pump chamber 142. In this manner the pump chamber 142 is filled with product from a container which is connected to or in communication with the trigger sprayer 100.

Repeat actuation of the trigger lever 152 again biases the bias member 154. At the same time, piston 140 is moved into the valve body 120, thereby decreasing the volume of the pump chamber 142. As the volume of the pump chamber 142 is reduced, product or fluid in the pump chamber 142 escapes through the fluid passageway 123. Fluid pressure on the backside of inlet valve 111 presses the inlet valve 111 against the walls of the valve body 120, which may prevent fluid or product from returning through the inlet valve 111. As pressure builds, the outlet valve 112 flexes, allowing fluid or product to escape around the outlet valve 112 and into the discharge passageway 124. Fluid in the discharge passageway 124 is then released through the nozzle 160 with a particular spray pattern caused by the nozzle 160 and valve body 120 or nozzle 360 and nozzle insert 362.

As the trigger lever 152 is released, the piston 140 is again pulled away from the valve body 120 causing a pressure change. This pressure change closes the outlet valve 112 and begins to draw fluid or product back into the pump chamber 142 through the inlet valve 111 and fluid passageway 123.

According to various embodiments of the invention, all of the components of a trigger sprayer may be molded from a single type of material, such as from a resin or plastic material. According to some embodiments of the invention, all of the components of a trigger sprayer may be molded using a polypropylene material. Other plastics and materials may be used as desired.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A trigger sprayer, comprising:

a plastic valve body;

a tube retainer positioned in the valve body, comprising:

an inlet valve; and an outlet valve;

a piston positioned in the valve body;

a trigger comprising a trigger lever portion and an integrally formed bias member portion, said trigger lever portion being attached to said piston and having an upper end pivotably secured to said valve body; and a plastic shroud having an upper wall, opposing side walls and a rear wall, said shroud being removably received and secured in interfitting relation around said valve body and said trigger, said bias member portion extending rearwardly from said upper end of said trigger lever portion within a space formed between said upper wall of said shroud and said valve body, said bias member portion having a bias wing at a terminal end thereof, said bias wing engaging said rear wall of said shroud, said shroud further including a bias member guide interacting with said bias member portion to guide movement thereof during actuation of said trigger.

2. The trigger sprayer of claim 1, wherein the trigger lever portion and the bias member portion comprise a single, molded component formed of polypropylene.

3. The trigger sprayer of claim 1, wherein the tube retainer and trigger are plastic.

4. The trigger sprayer of claim 3, wherein the tube retainer and trigger are each polypropylene.

5. The trigger sprayer of claim 1, wherein the bias member portion of the trigger further comprises an elongated longitudinal slot extending from the trigger lever portion towards the bias wing.

6. The trigger sprayer of claim 5, wherein the bias member guide comprises a longitudinally extending support which is received in the slot in the bias member portion.

7. A trigger sprayer, comprising:

a molded, plastic valve body;

a molded, plastic shroud, comprising at least one valve body attachment, wherein the molded, plastic shroud is attached to the molded, plastic valve body by the at least one valve body attachment; and a trigger comprising a trigger lever portion having an upper end pivotably secured to said molded, plastic valve body, said trigger further having an integrally formed bias member portion extending rearwardly from said upper end of said trigger lever portion between the molded, plastic valve body and the molded, plastic shroud wherein the bias member portion moves freely within an interior space between the molded, plastic shroud and the molded, plastic valve body said molded, plastic shroud further having an upper wall, sidewalls and a rear wall which are received around the molded, plastic valve body and the trigger.

8. The trigger sprayer of claim 7, further comprising a bias member guide wherein movement of the bias member portion is guided by the bias member guide.

9. The trigger sprayer of claim 8, further comprising an elongated longitudinal slot in the bias member portion wherein the bias member guide is positioned in the slot when the trigger sprayer is assembled.

* * * * *